US005212670A

United States Patent [19]

Brown

[11] Patent Number: 5,212,670

[45] Date of Patent: May 18, 1993

[54] FLEXTENSIONAL HYDROPHONE

[75] Inventor: David A. Brown, Salinas, Calif.

[73] Assignee: The United States of America as represented by the Secretary of the Navy, Washington, D.C.

[21] Appl. No.: 916,646

[22] Filed: Jul. 20, 1992

[51] Int. Cl.[5] ..... H04R 23/00

[52] U.S. Cl. ..... 367/149; 367/174; 73/657; 356/345; 356/360; 359/191

[58] Field of Search ..... 367/140, 141, 149, 171, 367/172, 178, 174; 181/122; 73/655, 657; 356/345, 360; 359/141, 195, 190, 191; 350/96.29, 96.3

[56] References Cited

U.S. PATENT DOCUMENTS

| | | | |
|---|---|---|---|
| 4,534,222 | 8/1985 | Finch et al. | 73/653 |
| 4,799,752 | 1/1989 | Carome | 367/149 |
| 4,893,930 | 1/1990 | Garrett et al. | 356/345 |
| 4,932,783 | 6/1990 | Kersey et al. | 356/345 |
| 4,951,271 | 6/1990 | Garrett et al. | 367/141 |
| 4,994,668 | 2/1991 | Lagakos et al. | 356/345 |
| 5,140,559 | 8/1992 | Fisher | 367/149 |

*Primary Examiner*—J. Woodrow Eldred
*Attorney, Agent, or Firm*—Kenneth L. Warsh; Wayne O. Hadland

[57] ABSTRACT

An omnidirectional hydrophone having an elastic shell in the form of an oblate ellipsoid of revolution having the ratio of its major axis to is minor axis greater than about $\sqrt{(2-\nu)}$ where $\nu$ is Poisson's ratio of the shell material, wherein the circular circumference of the shell (at different circular parallels of latitude) undergoes strains of opposite sign when the shell is subjected to a pressure change. The differential strains are advantageously measured by an optical fiber interferometer having one leg wound about the equatorial circumference of the shell and another leg spirally wound near one or both of the poles.

6 Claims, 4 Drawing Sheets

FLEXTENSIONAL HYDROPHONE

FIELD OF THE INVENTION

This invention relates to acoustic vibration sensing apparatus that utilize a closed hollow ellipsoidal shell with at least two wrappings of optical fiber on its surface, and more particularly to an improvement to an under-water acoustic vibration sensing apparatus (a hydrophone) resulting from positioning the wrappings parallel to one another.

DESCRIPTION OF THE PRIOR ART

The present invention is an improvement to a prior-art hydrophone identified as the first of several embodiments disclosed in U.S. Pat. No. 4,951,271 to Garrett et al., entitled Flextensional Hydrophone (hereinafter referred to as "the '271 patent") which is incorporated herein by reference. That prior-art hydrophone (shown herein at FIG. 2) is comprised of a closed hollow thin-walled shell in the shape of an ablate ellipsoid, having a first wrapping of optical fiber wound about the circular equatorial circumference and a second wrapping of optical fiber wound about an elliptical meridional circumference (i.e., having a cross-wrapped configuration).

A cross-wrapped configuration requires that one wrapping of optical fiber necessarily overlaps the other (in FIG. 2 the meridional wrapping is shown overlapping the equatorial wrapping). A crossed-wrapped configuration also requires that the meridional wrapping bends around the ellipsoid minimum radius of curvature ($r_E$, at the equator) which becomes smaller with more shallow (i.e., with higher aspect ratio) ellipsoids. Optical fibers have a minimum bending radius, which can therefore limit the aspect ratio and the minimum size of the ellipsoidal shell. Hence there is a need for a wrapping configuration that will avoid having the fibers overlap and also avoid having the fibers bend across the ellipsoid minimum radius of curvature.

OBJECTS, FEATURES, AND ADVANTAGES

It is an object of the present invention to position the wrappings of optical fiber so that they do not overlap one another.

It is another object of the present invention to position the wrappings of optical fiber so as to minimize the curvature of the fiber.

It is a feature of the present invention that the individual wrappings are positioned parallel to one another, one positioned near the equator, and another positioned near a pole.

It is an advantage of the present invention that a wrapping near a pole will be strained in direction opposite to that of a wrapping near the equator when the shell is subjected to a change in ambient pressure.

SUMMARY OF THE INVENTION

These and other objects and advantages are provided by the present invention of an improved omnidirectional hydrophone having a closed hollow elastic shell in the form of an oblate ellipsoid of revolution which undergoes strain when subjected to a change in ambient pressure such that, at separated parallels of latitude, the circular circumferences of the shell are strained in opposite directions. This differential strain may be effectively measured by an optical fiber interferometer having a first leg wound about a region near the circular equatorial circumference of the shell and a second leg wound about a parallel but necessarily smaller circular region near a pole of the ellipsoidal shell. A hydrophone of the present invention is particularly effective when the oblate ellipsoidal shell has a ratio of its major axis to its minor axis greater than about $\sqrt{(2-\nu)}$, where $\nu$ is Poisson's ratio (a property of the shell material).

The features of the present invention will be apparent from the following detailed description when considered in conjunction with the accompanying drawings.

DESCRIPTION OF THE PREFERRED EMBODIMENT

Figure 1:
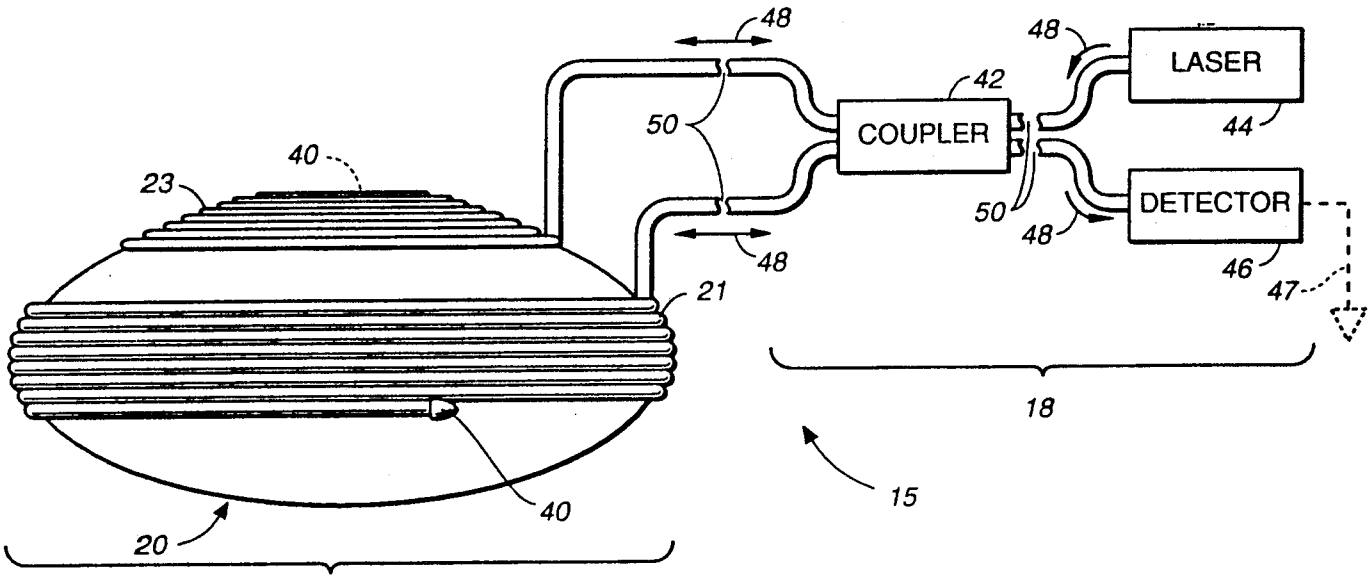
FIG. 1 is an exterior view of a parallel-wrapped hydrophone of the present invention, characterized by an oblate ellipsodal shell having a first length of optical fiber wrapped circumferentially about a region near the shell equator and a second length of optical fiber wrapped in a tight spiral near one pole, with the optical fibers connected as legs of a diagrammatically represented interferometer.

Referring now to the drawings wherein like reference numerals are used to designate like or corresponding parts throughout the various figures thereof, there is shown in FIG. 1 the improved flextensional hydrophone 15 of the present invention. The present invention is an improvement to a prior-art hydrophone 14 (shown in FIG. 2) identified as the first several embodiments disclosed in U.S. Pat. No. 4,951,271 to Garrett et al., entitled Flextensional Hydrophone (hereinafter referred to as "the '271 patent") which is incorporated herein by reference. Both the hydrophone of the present invention 15 and the prior-art hydrophone 14 are each composed of two subsystems, viz: a transducer subsystem (17 or 16 respectively), and a signal processor subsystem 18.

Figure 2:
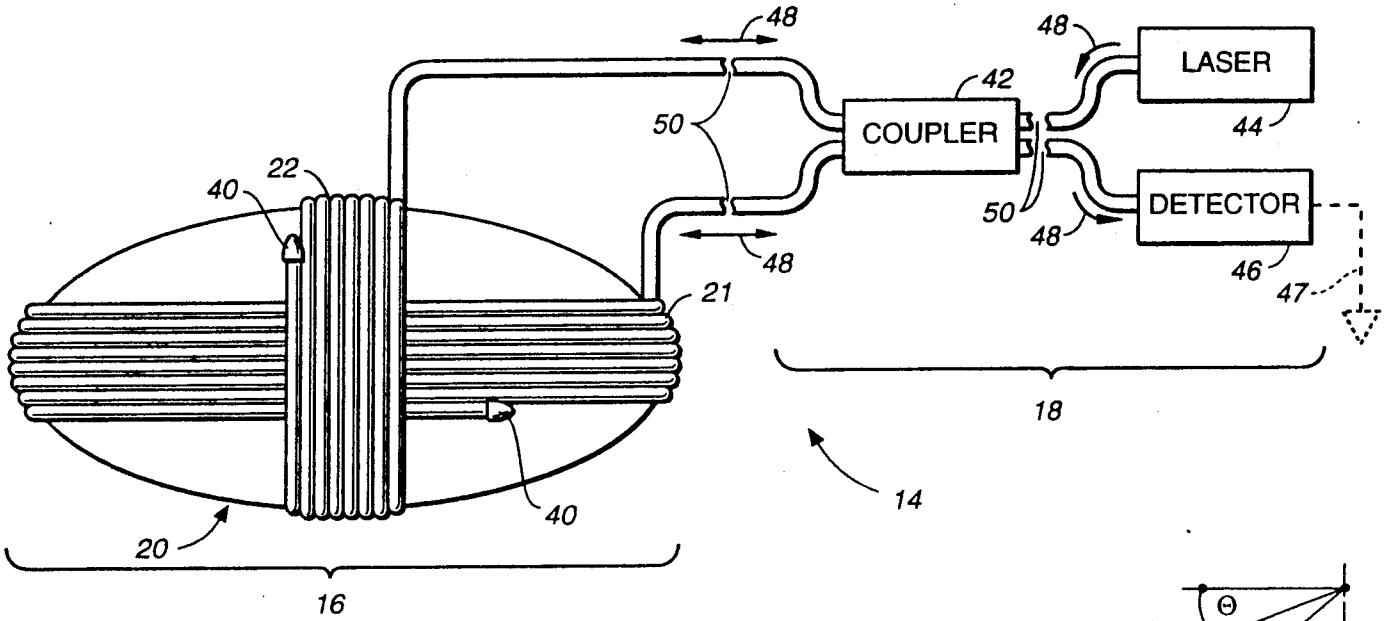
FIG. 2 (PRIOR ART)
FIG. 2 is an exterior view of a prior-art cross-wrapped hydrophone, this embodiment being characterized by an ellipsoidal shell having optical fibers wrapped meridionally and equatorially about the shell exterior, with the optical fibers connected as legs of a diagrammatically represented interferometer.

The signal processor subsystem 18 for the improved hydrophone 15 is the same signal processor subsystem 18 as used by the prior-art hydrophone 14, as illustrated in FIGS. 1 and 2 respectively.

The transducer subsystem 16 for the prior-art hydrophone 14 (shown in FIG. 2) is comprised of a closed hollow thin-walled shell 20 of uniform wall thickness made of an isotropic elastic material and being in the shape of an oblate ellipsoid, having a first wrapping of optical fiber 21 wound about the circular equatorial circumference of the shell 20 and adhesively bonded thereto, and a second wrapping of optical fiber 22 wound about an elliptical meridional circumference of the shell 20 and adhesively bonded thereto (i.e., having a cross-wrapped configuration).

The following portions of the disclosure of the '271 patent (which pertain to the first embodiment of the prior-art invention disclosed therein) are most relevant: (a) FIGS. 1, 2, and 4 thereof; (b) The portions of the "Brief Description of the Drawings" pertaining to FIGS. 1, 2, and 4 thereof; (c) The portions of the "Detailed Description" extending from column 3 line 26 through column 8 line 13; and (d) the entirety of "Example" extending from column 10 line 9 through column 12 line 67.

When referring to the '271 patent the following errors and omissions (all at column 6 thereof) should be recognized. At line 12, $\epsilon_<$ should have been printed as $\epsilon_{22}$. At lines 34 and 35, the two equations should have been identified as (3) and (4) respectively. At line 58 it is obvious that the two inequality signs should be reversed. Notice should also be taken of the following difference in symbology for strain ($\epsilon$), viz:

The symbol $\epsilon_\theta$ (as used herein) is synonymous with the symbol $\epsilon_{11}$ (as used in the '271 patent), both meaning strain in the $\theta$ direction (i.e., along a circle parallel to the equator).

The symbol $\epsilon_\phi$ (as used herein) is synonymous with the symbol $\epsilon_{22}$ (as used in the '271 patent), both meaning strain in the $\phi$ direction (i.e., in a direction along a meridian).

The Naval Postgraduate School Technical Document No. NPS-PH-91-009, entitled Optical Fiber Interferometric Acoustic Sensors Using Ellipsoidal Shell Transducers (hereinafter referred to as "NPS-PH-91-009" is also germane. Copies of this document may be requested from the Superintendent, Code 043, of the Naval Postgraduate School via the Defense Technical Information Center, Cameron Station, Alexandria, VA 22304-6145. The most relevant pages of NPS-PH-91-009 are pages 18 through 33, 43 through 55, and 113 through 121. The symbology used herein (except for the symbols $\alpha$, $\gamma$, and $r_E$ which are used herein) is consistent with the symbology used in NPS-PH-91-009.

Symbology $\phi$ = the angle between the normal to the differential surface element and the axis of revolution of the ellipse defining the surface $\theta$ = the circumferential angle between an arbitrary reference meridian and the position of a differential surface element $\epsilon_\phi$ = the strain of an element of the shell in the $\phi$ direction (i.e., along a meridian thereof)

$\epsilon_\theta$ = the strain of an element of the shell in the $\theta$ direction (i.e., along a circle parallel to the equator thereof)

t = the shell wall thickness

E = the modulus of elasticity (Young's modulus) of the shell material $\nu$ = Poisson's ratio of the shell material a = the length of an ellipse semi-major axis b = the length of an ellipse semi-minor axis e = the eccentricity of an ellipse $\alpha$ = the aspect ratio of an ellipse $= a/b = \sqrt{\{1/(1-e^2)\}}$ $r_E = b/a^2 = b/\alpha = a/\alpha^2$, the minimum radius of curvature of an ellipsoid (at the equator)

Figure 4:
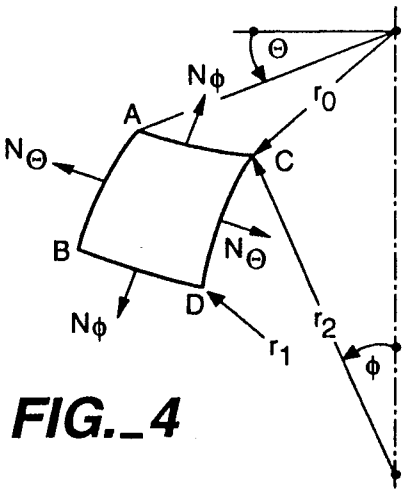
FIG. 4 shows membrane tensions denoted by $N_\theta$ and $N_\phi$, which have units of force per unit length and act normal to the sides of a shell differential surface element ACDB (also shown in FIG. 3).
Figure 5:
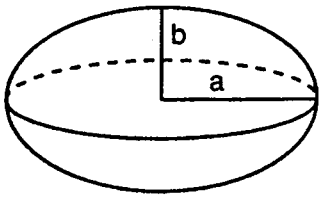
FIG. 5 shows an oblate ellipsoid surface, obtained by rotating an ellipse having its semi-major axes (designated "a") greater than its semi-minor axes (designated "b") about an axis of revolution that is collinear with its semi-minor axes (here b is shown as the vertical axis).
Figure 3:
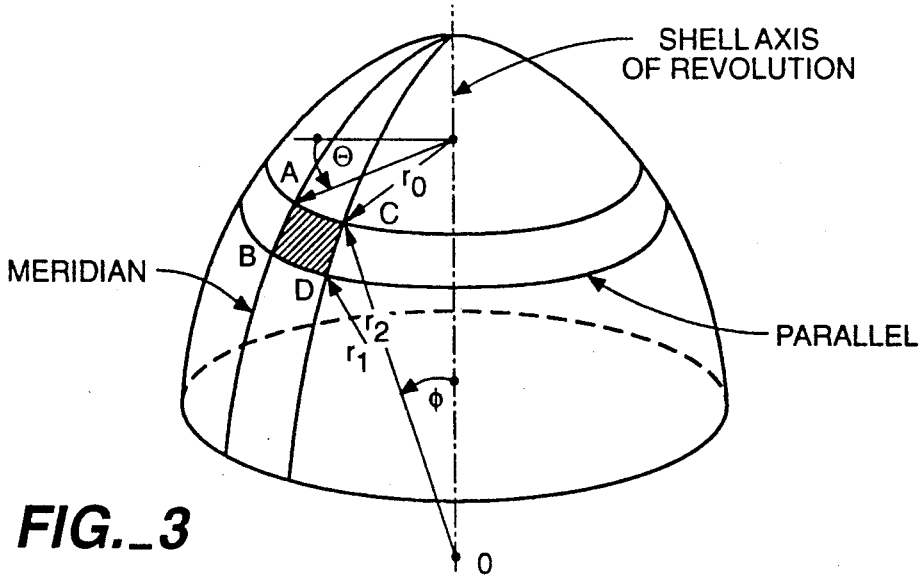
FIG. 3 shows a portion of the surface of a shell of revolution and its coordinate system.

$\gamma = \sqrt{\{\alpha^2 \sin^2\phi + \cos^2\phi\}}$, a convenient grouping of terms A portion of the surface of a shell of revolution and its coordinate system is shown in FIG. 3. A surface of revolution, as shown in FIG. 3, is obtained by rotating a plane curve about an axes of revolution. The axes of revolution is coplanar with the meridian plane curve. The position of a differential surface element (shown as ACDB in FIGS. 3 and 4) on the surface of revolution is specified by a circumferential angular distance $\theta$ measured from an arbitrary reference meridian, and by the angle $\phi$ made by the normal to the differential surface element and the axis of revolution. Note that $\phi$ is not the usual polar angle $\phi_{polar}$ which is directed from the origin of the Cartesian coordinate axes (unless the generating curve is a circle, in which case $\phi = \phi_{polar}$). The principal radii of curvature of this differential element are denoted by $r_1$ and $r_2$. As illustrated in FIGS. 3 and 4, $r_1$ is the radius of curvature lying in the meridional plane perpendicular to differential surface element. The radius of curvature $r_2$ is associated with the curvature of the differential surface in the plane perpendicular to both the differential surface element and to the aforementioned meridional plane; $r_2$ has a length CO, measured from the differential surface element to the axis of revolution. The radius of curvature of the parallel AC (which is a circular segment) is simply $r_0$ (thus the two radii $r_0$ and $r_2$ are related, as $r_0 = r_2 \sin \phi$).

FIG. 4 shows membrane tensions denoted by $N_\theta$ and $N_\phi$, which have units of force per unit length and act normal to the sides of the shell differential surface element ACDB. These membrane tensions result from a uniform pressure loading applied to a closed shell of revolution, and can be determined from linear membrane theory in order to obtain the strain induced in optical fibers bonded to the shells.

As used herein, the word ellipsoid (with or without the modifier oblate) is defined to mean an oblate ellipsoid of revolution, being the three-dimensional surface generated by rotating an ellipse about its minor axis; it has one shortest axis which is its minor axis, and it has a plurality of longer or major axes. Hence the equator is a circle in the plane of symmetry normal to the minor axis and has a radius represented by "a"; while each meridian is in a plane including the minor axis and intersects the minor axis at its two poles at a radius "b".

As used herein, the word shell is defined to mean a closed hollow thin-walled structure made of an isotropic elastic material, having a wall of uniform thickness and being in the shape of an oblate ellipsoid having two opposed poles. A thin-walled shell is a shell with walls sufficiently thin in relation to its overall dimensions such that it is amenable to stress analysis based on membrane theory (wherein the stress distribution is essentially invariant radially across the shell wall).

For an oblate ellipsoidal shell having an aspect ratio $\alpha$ ($\alpha = a/b$) greater than $\sqrt{(2-\nu)}$, the shell (when subjected to a uniform external pressure loading) will deform in such a way as to undergo an increase in its equatorial circumference and a decrease in its meridional circumference.

FIG. 2 (prior-art) shows the transducer subsystem 16 of the aforementioned prior-art hydrophone 14 (disclosed in the '271 patent) characterized by an oblate ellipsoidal shell 20 having an equatorial wrapping 21 and a meridian wrapping 22 of optical fiber. Shell 20 is adapted for immersion in a fluid having pressure variations to be sensed by the hydrophone 14 utilizing the shell 20 and its respective wrappings 21 and 22 comprising the transducer subsystem 16. The equatorial and meridional circumferences of ellipsoidal shell 20 vary differentially in length when the shell is subjected to a pressure variation. It is evident that by adhesively bonding optical fiber wrappings 21 and 22 to the shell 20 that these windings will have variations in length corresponding to the strain induced therein by the shell. Wrappings 21 and 22 are thus a pair of strain detecting elements for detecting differential variations in the shell circumferences. An equatorial circumference or wrapping, such as wrapping 21 traces a circle about the minor axis of a shell; a meridional circumference or wrapping, such as wrapping 22, traces an ellipse in the plane of the minor axis (i.e., the axis of revolution).

As further shown in FIG. 2 (prior art), and also in FIG. 1, these differential variations in shell and wrapping strains may be detected interferometrically by connecting such a pair of optical fiber wrappings (21 and 22 in FIG. 2; or 21 and 23 in FIG. 1) as the legs of an optical fiber Michelson interferometer. When so connected, one end of each wrapping is a reflector, and may be protected by any suitable cap 40. The other wrapping ends are connected to one side of any suitable coupler 42, from the other side of which one optical fiber leads to a laser 44 and another optical fiber leads to a detector 46 which outputs an electronic signal represented by arrow 47. This signal 47 corresponds to interference fringes generated by the varying lengths of the wrappings as light from laser 44 passes through the fibers (as indicated by arrows 48) so as to be reflected from capped ends 40 and interfere in coupler 42. Signal 47 thus corresponds to the differential variations in shell circumference caused by ambient pressure changes.

The coupler 42, the laser 44, and the detector 46 comprise the signal processor subsystem 18 (which is common to both the prior-art 14, and to the present 15, flextensional hydrophones). As indicated by breaks 50 in the optical fiber near coupler 42, this coupler may be remote from shell 20 and may also be remote from relatively delicate apparatus such as laser 44 and detector 46.

It will be apparent to one skilled in the art of optical fiber interferometric strain measurement that each of the optical fiber wrappings (21 and 22, or 21 and 23) serves as a reference interferometer leg for the other.

Figure 1A:
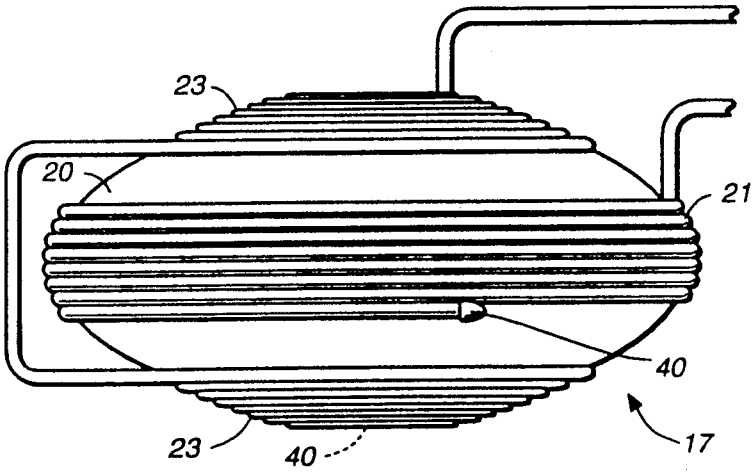
FIG. 1A shows an alternative wrapping arrangement to that shown in FIG. 1, wherein one-half of the spirally wrapped (second) length of optical fiber is placed near one pole, and the other one-half is placed near the opposite pole.

The improved flextensional hydrophone 15 of the present invention uses parallel wrappings 21 and 23 of optical fiber, as shown in FIGS. 1 and 1A. This is accomplished by replacing the meridional wrapping 22 that is used in the transducer 16 for the prior art hydrophone 14 (as disclosed in the '271 patent and as shown in FIG. 2) by a second circular fiber wrapping 23 (hereinafter also designated as a polar coil 23) in the transducer 17 for the improved hydrophone 15. The polar coil 23 is oriented parallel to the first circular fiber wrapping 21 (i.e., the equatorial wrapping) and located near a pole of the oblate ellipsoidal shell 20 (i.e. where $\phi = 0°$ or $180°$), as shown in FIG. 1. An alternate polar coil 23 winding arrangement for the transducer 17 is shown in FIG. 1A, where the second circular wrapping 23 is separated into two halves, each half being positioned near an opposite pole.

The polar circular circumferential stress is always compressive for a positive external ambient pressure. Thus, a polar coil 23 (bonded to the shell 20 near a pole) experiences strain of opposite sign to that experienced by the equatorial wrapping 21 (which is wrapped around and bonded to the shell 20 near the equator).

Figure 6:
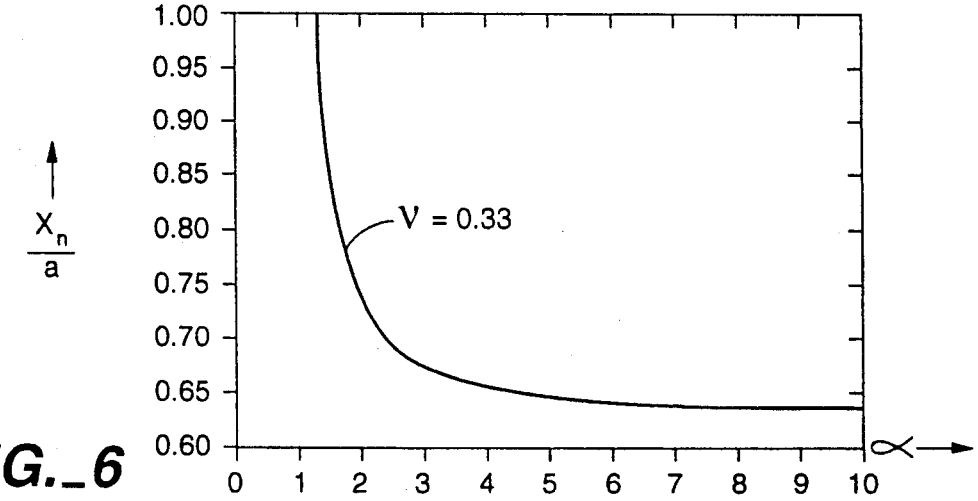
FIG. 6 is a plot giving the location of the x coordinate ($x_n$) for the nodal circle (where $\epsilon_\theta=0$), as a fraction of the length of the semi-major axis (a).
Figure 7:
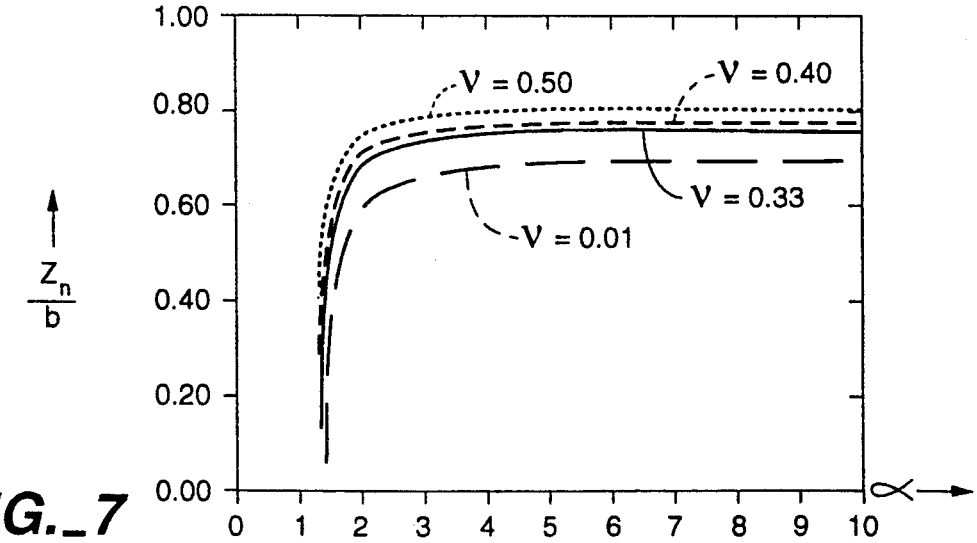
FIG. 7 is a plot giving the location of the z coordinate ($z_n$) for the nodal circle (where $\epsilon_\theta=0$), as a fraction of the length of the semi-minor axis (b).

It is of interest to determine the coordinates at which the circular $\theta$-strain changes sign. This "nodal circle" will set the limit to which the optical fiber of a given interferometric leg should be wrapped. FIG. 6 is a plot giving the location of the x coordinate ($x_n$) for the nodal circle (where $\epsilon_\theta = 0$), as a fraction of the length of the semi-major axis (a); FIG. 7 is a plot giving the location of the z coordinate ($z_n$) for the nodal circle (where $\epsilon_\theta = 0$), as a fraction of the length of the semi-minor axis (b). FIGS. 6 and 7 are plots of equations (1) and (2), respectively:

$$\frac{X_n}{a} = \alpha\sqrt{\frac{1-\nu}{(2-\nu)(\alpha^2-1)}} \tag{1}$$

$$\frac{Z_n}{b} = \sqrt{\frac{\alpha^2-2-\nu}{(2-\nu)(\alpha^2-1)}} \tag{2}$$

In order to determine whether the polar coil will experience sufficient strain, it is instructive to compare the magnitude of the strain experienced by the polar coil with the average strain experienced by the prior-art meridional wrapping; that is, to compare the $\theta$-strain at a pole (i.e., polar strain $\epsilon_\theta @ \phi = 0$), to that of the average meridional strain, $<\epsilon_\phi>$, where $<\epsilon_\phi>$ denotes the mean of the meridional strain ($\epsilon_\phi$) around the meridional circumference. This ratio is plotted in FIG. 8, and is given by equation (3) below:

$$\frac{\epsilon_\theta @ \phi = 0}{<\epsilon_\phi>} = \frac{\alpha^2(1-\nu)\sqrt{2(1-\alpha^2)}}{\alpha^2+1-2\nu} \tag{3}$$

Figure 8:
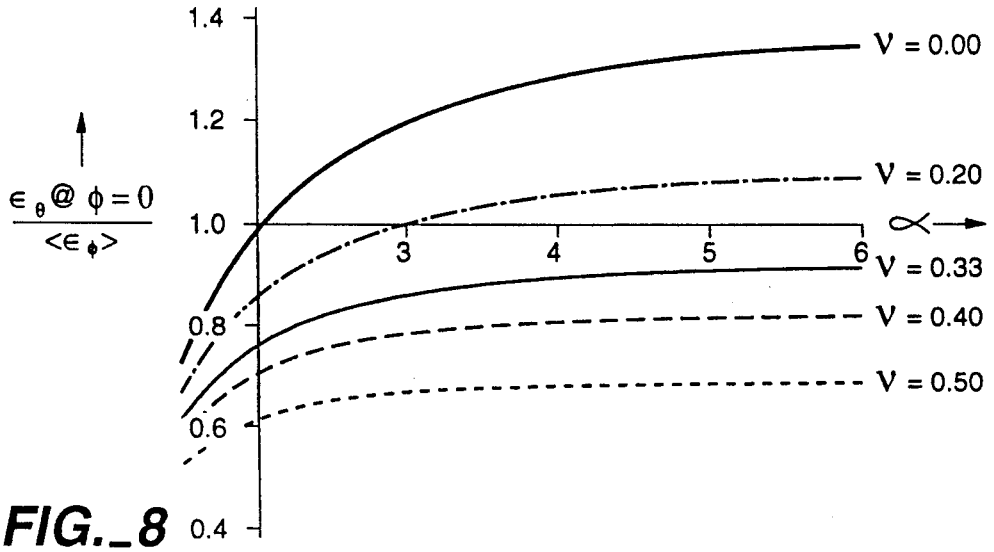
FIG. 8 is a plot of the ratio of the circular $\theta$-strain at either pole (e.g., polar strain @$\phi=0$), to that of the average meridional strain, $<\epsilon_\phi>$, where $<\epsilon_\phi>$ denotes the average of the meridional strain ($\epsilon_\phi$) around the meridional circumference.

As an example from FIG. 8, it is seen that for a Poisson's ratio $\nu$ of 0.20 and for an aspect ratio $\alpha$ of 3.0 the strains are equal. For aspect ratios greater than 5 (for any Poisson's ratio), the strain ratio is relatively constant.

As a practical matter it is of interest to investigate whether or not a sufficient quantity of fiber can be accommodated near the pole. This is addressed by examining the ratio of $\theta$-strain ($\epsilon_\theta$) at and away from the pole. The $\theta$-strain in terms of angle $\phi$ is given in equation (4) below:

$$\frac{\epsilon_\theta}{\epsilon_\theta @ \phi = 0} = \frac{2 - \nu - \gamma^2}{\gamma(1 - \nu)} \quad (4)$$

Figure 9:
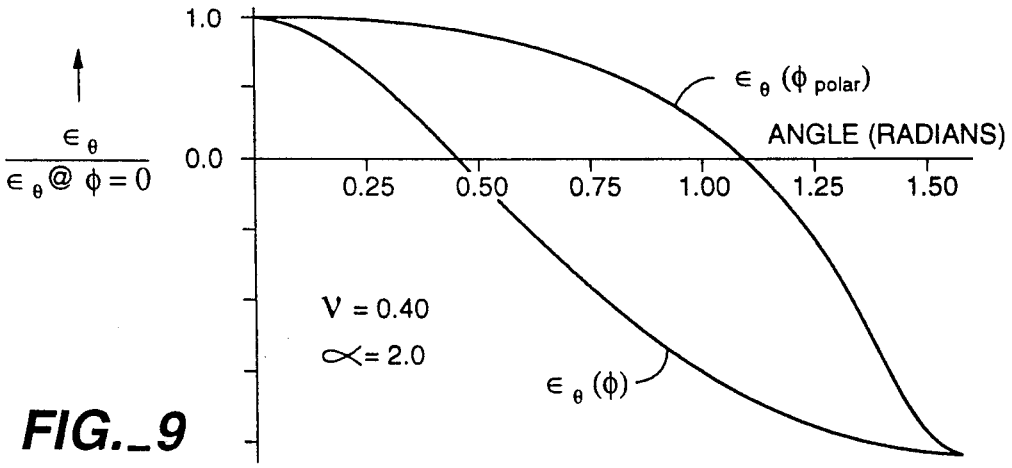
FIG. 9 is a plot of the ratio of $\epsilon_\theta$ (normalized to the value of $\epsilon_\theta$ at $\phi=0$) versus $\phi$ (and independently on the same graph versus the polar angle $\phi_{polar}$) for angles from 0 to $\pi/2$ radians, for the case where Poisson's ratio $\nu=0.4$ and the aspect ratio $\alpha=2$.
Figure 10:
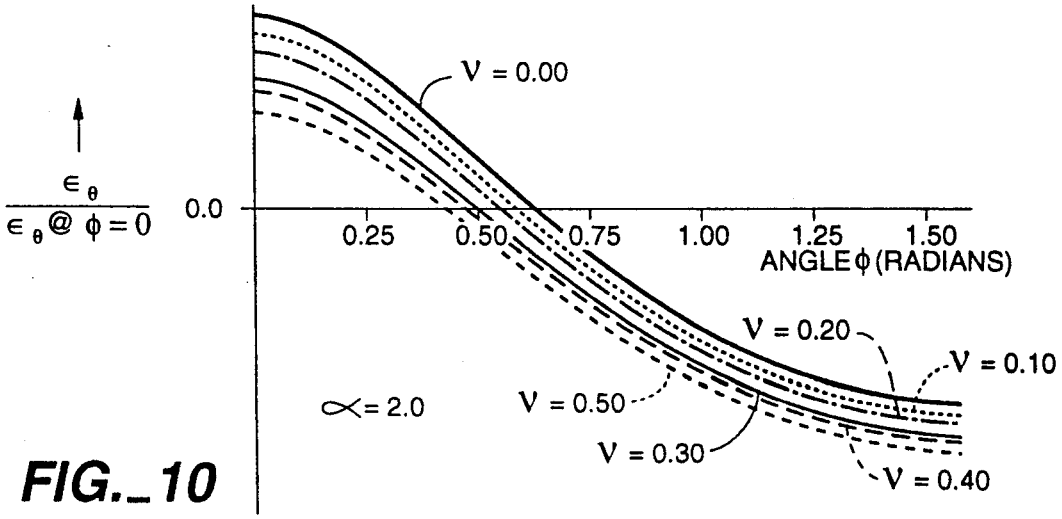
FIG.10 shows the relative effect of changes in Poisson's ratio upon the lower curve of FIG. 9.

In FIG. 9 $\epsilon_\theta$(normalized to the value of $\epsilon_\theta$ at $\phi=0$) is plotted versus $\phi$ (and independently on the same graph as a function of the polar angle $\phi_{polar}$) for angles from 0 to $\pi/2$ radians, for the case where Poisson's ratio $\nu=0.4$ and the aspect ratio $\alpha=2$. It should be noticed that for any particular value of $\epsilon_\theta$, $\phi$ is always less than $\phi_{polar}$, which is consistent with the definition of these angles. Note that there is a large region ($\pm 0.5$ radians in $\phi_{polar}$) where there is little change in the magnitude of $\epsilon_\theta$. From this plot it can also be seen that the strain does indeed change sign, reaching a maximum absolute magnitude at the equator (at $\phi_{polar}=\phi=\pi/2$ radians). FIG. 10 shows the relative effect of changes in Poisson's ratio upon the lower curve of FIG. 9.

While this invention has been described in conjunction with a preferred embodiment thereof it is obvious that modifications and changes therein may be made by those skilled in the art without departing from the scope of this invention as defined by the claims appended hereto.

That which is claimed is:

1. In combination with a transducer including (1) a closed hollow thin-walled shell of uniform wall thickness made of an elastic material and having an exterior surface in the shape of an oblate ellipsoid having two opposed poles, (2) a first wrapping of optical fiber wound about the circular equatorial circumference of the ellipsoidal shell surface and bonded thereto, and (3) a second wrapping of optical fiber wound about the ellipsoidal shell surface and bonded thereto, the improvement wherein the second wrapping of optical fiber is oriented parallel to the ellipsoidal shell circular equatorial circumference and located near a pole.

2. In combination with a transducer and the improvement as recited in claim 1, the further improvement wherein one-half of the second wrapping of optical fiber is located near one of the poles and the other one-half of the second wrapping of optical fiber is located near the opposite pole.

3. In combination with a hydrophone including (1) a closed hollow thin-walled shell of uniform wall thickness made of an elastic material and having an exterior surface in the shape of an oblate ellipsoid having two opposed poles, (2) a first wrapping of optical fiber wound about the circular equatorial circumference of the ellipsoidal shell surface and bonded thereto, (3) a second wrapping of optical fiber wound about the ellipsoidal shell surface and bonded thereto, and connected to said first and second wrappings of optical fiber (4) a signal processing means for detecting relative changes in lengths of said first and second wrappings of optical fiber and for generating an electrical signal corresponding to said relative changes in lengths, the improvement wherein the second wrapping of optical fiber is oriented parallel to the ellipsoidal shell circular equatorial circumference and located near a pole.

4. In combination with a hydrophone and the improvement as recited in claim 3, the further improvement wherein one-half of the second wrapping of optical fiber is located near one of the poles and the other one-half of the second wrapping of optical fiber is located near the opposite pole.

5. In combination with a hydrophone including (1) a closed hollow thin-walled shell of uniform wall thickness made of an elastic material and having an exterior surface in the shape of an oblate ellipsoid having two opposed poles, (2) a first wrapping of optical fiber wound about the circular equatorial circumference of the ellipsoidal shell surface and bonded thereto, (3) a second wrapping of optical fiber wound about the ellipsoidal shell surface and bonded thereto, and connected to said first and second wrappings of optical fiber (4) a signal processing means for detecting relative changes in lengths of said first and second wrappings of optical fiber and for generating an electrical signal corresponding to said relative changes in lengths, said signal processing means including a coupler, a laser, and a detector, the improvement wherein the second wrapping of optical fiber is oriented parallel to the ellipsoidal shell circular equatorial circumference and located near a pole.

6. In combination with a hydrophone and the improvement as recited in claim 5, the further improvement wherein one-half of the second wrapping of optical fiber is located near one of the poles and the other one-half of the second wrapping of optical fiber is located near the opposite pole.

* * * * *